United States Patent [19]

Yoshioka et al.

[11] Patent Number: 4,882,087

[45] Date of Patent: Nov. 21, 1989

[54] AQUEOUS DISPERSED SOLUTION OF SUBSTITUTED SUCCINIC ANHYDRIDE AND PROCESS FOR PRODUCING THE SAME

[75] Inventors: Shigehiko Yoshioka; Hideto Yamada, both of Akashi; Hisatake Sato, Yokohama; Motokazu Kamei, Nagaoka, all of Japan

[73] Assignees: Seiko Kagaku Kogyo Co., Ltd., Hyogo; Nippon Co., Ltd., Tokyo; Hokuetsu Paper Mills, Ltd., Niigata, all of Japan

[21] Appl. No.: 213,476

[22] Filed: Jun. 30, 1988

Related U.S. Application Data

[63] Continuation of Ser. No. 779,125, Sep. 23, 1985, abandoned.

[30] Foreign Application Priority Data

Sep. 25, 1984 [JP] Japan ..... 59-200276

[51] Int. Cl.[4] ..... B01J 13/00; C08L 91/00; D21H 3/10

[52] U.S. Cl. ..... 252/312; 106/243; 162/168.3; 252/314

[58] Field of Search ..... 252/312; 162/168.3; 106/213, 243; 526/307.2

[56] References Cited

U.S. PATENT DOCUMENTS

| | | | |
|---|---|---|---|
| Re. 29,960 | 4/1979 | Mazzarella et al. | 162/158 |
| 2,853,471 | 9/1958 | Beadell | 252/DIG. 1 |
| 3,102,064 | 8/1963 | Wurzburg | 162/158 |
| 4,060,679 | 11/1977 | Naarmann et al. | 526/304 |
| 4,533,434 | 8/1985 | Yoshioka et al. | 162/168.3 X |
| 4,545,855 | 10/1985 | Sweeney | 162/158 |
| 4,576,680 | 3/1986 | Kawatani et al. | 162/158 |
| 4,606,773 | 8/1986 | Novak | 106/213 |
| 4,657,946 | 4/1987 | Rende et al. | 523/402 |

FOREIGN PATENT DOCUMENTS

| | | | |
|---|---|---|---|
| 1186857 | 5/1985 | Canada . | |
| 0041056 | 12/1981 | European Pat. Off. . | |
| 0085330 | 1/1983 | European Pat. Off. . | |
| 0122167 | 4/1984 | European Pat. Off. . | |
| 0151994 | 1/1985 | European Pat. Off. . | |
| 3105903 | 9/1982 | Fed. Rep. of Germany | 162/168.3 |
| 803358 | 10/1980 | Finland . | |
| 0051899 | 3/1982 | Japan | 162/168.3 |
| 58-134051 | 8/1983 | Japan . | |
| 60-28598 | 2/1985 | Japan . | |
| 2006744 | 5/1979 | United Kingdom . | |
| 1601464 | 10/1981 | United Kingdom . | |

OTHER PUBLICATIONS

Abstract Bulletin of the Institute of Paper Chemistry, vol. 54, No. 10, Apr. 1984, p. 1220, No. 11479, Appleton, Wisc., U.S.; and JP-A-83 46196 (Seiko) 17-0-3-1963.

Abstract Bulletin of the Institute of Paper Chemistry, vol., 54, No. 10, Apr. 1984, p. 1220, No. 11480, Appleton, Wisc., U.S.; and JP-A-83 46197 (Seiko) 17-0-3-1983.

Abstract Bulletin of the Institute of the Paper Chemistry, vol. 57, No. 1, Jul. 1986, p. 134, Abstract No. 1087.

Chemical Abstract vol. 103, No. 4, Jul. 1985, p. 79, Abstract No. 24007d.

Abstract Bulletin of the Institute of Paper Chemistry, vol. 54, No. 11, May 1984, p. 1340, Abstract No. 12666.

Abstract Bulletin of the Institute of Paper Chemistry, vol., 54, No. 3, Sep. 1983, p. 350, Abstract No. 3226.

Abstract Bulletin of the Institute of Paper Chemistry, vol. 55, No. 2, Aug. 1984, pp. 245-246, Abstract No. 2297.

Organic Chemistry, 3d Ed., Fieser et al., pp. 188-189, 1956.

*Surface Active Ethylene Oxide Adducts,* N. Schonfeldt, Ph.D., Sep. 13, 1971, pp. 655-657.

WO/85627 (PTC), Yoshioka et al., Feb. 1985.

*Primary Examiner*—Richard D. Lovering

*Attorney, Agent, or Firm*—Oliff & Berridge

[57] ABSTRACT

An aqueous dispersed solution of a substituted succinic anhydride which comprises an aqueous soluble copolymer (A) having 50 percent or more by mol of (meth)acrylamide (a) 1 percent or more by mol of N,N-dialkylamino.alkyl(meth)acrylamide (b) as monomer ingredients, aqueous soluble copolymer (B) having 50 percent or more by mol of (meth)acrylamide (a), 1 percent or more by mol of N,N-dialkylamino.alkyl(metho)acrylamide (b) and 49 percent or less by mol of other copolymer monomer (c) as monomer ingredients, or both of the dqueous soluble copolymer (A) and the aqueous soluble copolymer (B), and a process for producing an aqueous dispersed solution of a substituted succinic anhydride prepared by dispersing the aqueous soluble copolymer (A) or the aqueous soluble copolymer (B) or a mixture (C) of 99 to 99.9 percent by weight of the substituted succinic anhydride (d) and 10 to 0.1 percent by weight of an oil-in-water type surfactant (e) in aqueous solution containing both the aqueous soluble copolymer (A) and the aqueous soluble copolymer (B). Thus, the aqueous dispersion can provide an excellent sizing effect in case applied as a sizing agent in paper making process but also has preferable dilute dispersibility of aqueous dispersion, does not possibly contaminate wires, rolls and carpets of a paper making machine when applied as a sizing agent in the practical paper making process with properties of capable of continuously operating for a long period of time.

4 Claims, No Drawings

AQUEOUS DISPERSED SOLUTION OF SUBSTITUTED SUCCINIC ANHYDRIDE AND PROCESS FOR PRODUCING THE SAME

This is a continuation of application Ser. No. 779,125 filed Sept. 23, 1985 and now abandoned.

BACKGROUND OF THE INVENTION

The present invention relates to an aqueous dispersed solution of a substituted succinic anhydride and a process for producing the same. More particularly, the present invention relates to such an aqueous dispersion of a substituted succinic anhydride used as a sizing agent having excellent sizing effect in paper making steps and exhibiting excellent operations even in a dilute stability and a process for producing the same.

There is known a sizing paper employing aqueous dispersed solution of a substituted succininc anhydride, and various types of aqueous dispersions have been heretofore proposed.

For example, an aqueous dispersion prepared by mixing an aqueous solution of cationic starch and a substituted succinic anhydride by a strong mechanical agitation in a homogeneous state (disclosed in Japanese Patent Publication No. 2305/1964 official gazette), an aqueous dispersion prepared by dispersing a substituted succinic anhydride in water or an aqueous solution of specific aqueous soluble polymer substance with the aid of a selected surfactant (disclosed in Japanese Patent Publication No. 36044/1978 official gazette, Japanese Patent Laid-open No. 45731/1983 official gazette, Japanese Patent Laid-open No. 47498/1984 official gazette), and further an aqueous dispersion prepared by dispersing a substituted alkyl-substituted or alkenyl-substituted succinic anhydride or a mixture (a) of the succinic anhydrides which contain 70 to 99.9 percent by weight and a mixture (b) of polyoxyethylene alkyl-ether phosphoric acid ester, polyoxyethylene alkylaryl ether phosphoric acid ester or the mixture of these phosphoric acid esters which contain 0.1 to 30 percent by weight in water with the aid of an aqueous solution of aqueous soluble polymer compound (disclosed in Japanese Patent Application No. 134051/1983).

However, in the abovementioned aqueous dispersion employing the former cationic starch of the aqueous dispersions of the substituted succinic anhydrides, a considerably large apparatus is not only required to disperse the substituted succinic anhydride in water, but it is difficult to sufficiently pulverize the aqueous dispersed solution thus obtained into fine dispersion particles, and the resultant dispersion has such a disadvantage that the dispersion cannot avoid the slight decrease in the sizing performance.

In the above-described aqueous dispersion employing the latter mixture of the aid, the prepared mixture loses its stability in presveration and cannot secure a sufficient dispersibility of the substituted succinic anhydride in water, and the resultant aqueous dispersion not only loses its sizing effect with the lapse of time after preparation but deteriorates in the dispersibility of the substituted succinic anhydride having an internal olefin structure adapted for a sizing agent in water.

Further, the aqueous dispersion utilizing the substituted-alkyl succinic anhydride or substituted-alkenyl succinic anhydride or the mixture of both has been proposed to have excellent properties for a preservation stability as the disadvantage of the mixture of the air of the substituted succinic anhydride of light and the surfactant in the mixture prepared by dispersing a substituted alkyl-substituted or alkenyl-substituted succinic anhydride or a mixture (a) of the succinic anhydrides which contain 70 to 99.9 percent by weight and a mixture (b) of polyoxyethylene alkyl-ether phosphoric acid ester, polyoxyethylene alkylaryl ether phosphoric acid ester or the mixture of these phosphoric acid esters which contain 0.1 to 30 percent by weight in water with the aid of an aqueous solution of aqueous soluble polymer compound, and the resultant aqueous dispersion further provides preferable dispersibility in water for the substituted succinic anhydride having an internal olefin structure as a sizing agent as its merits, but when the aqueous dispersion obtained from this mixture is used as a sizing agent in an industrial scale, some problems are still retained. In other words, the aqueous dispersion of the substituted succinic anhydride obtained from the mixture proposed in Japanese Patent Application No. 134051/1983 exhibits dilute stability of the aqueous dispersion in case that the cationic starch dissolved in water of continuous state is contained in the aqueous dispersion, but, in other case, causes insufficient dilute stability, and when this aqueous dispersion is employed as a sizing agent in the practical paper making process, the dispersion has such a drawback that it contaminates the wires, rolls and carpets of the paper making machine and cannot operate continuously for a long period of time.

If the mixture is dispersed in the aqueous solution dissolved with the cationic starch in advance when preparing the aqueous dispersion from the abovementioned mixture in this case, the aqueous dispersed solution having preferable dilute stability can be prepared, but the aqueous solution of the cationic starch itself is unstable in an ageing manner, and the cationic starch should be dissolved in water immediately before using the aqueous dispersion as a sizing agent as well as the dispersibility of the substituted succinic anhydride of the starch in water is small. Thus, a negative factor that a strong or large-scale emulsifying apparatus for preparing the aqueous dispersion is indispensably required.

SUMMARY OF THE INVENTION

Accordingly, an object of the present invention is to provide an aqueous dispersed solution of a substituted succinic anhydride which can not only secure an excellent sizing effect in case applied as a sizing agent in paper making process but also has preferable dilute dispersibility of aqueous dispersion, does not possibly contaminate wires, rolls and carpets of a paper making machine when applied as a sizing agent in the practical paper making process with properties of capable of continuously operating for a long period of time, and a process for producing the same.

According to an aspect of the present invention, there is provided an aqueous dispersed solution of a substituted succinic anhydride which comprises an aqueous soluble copolymer (A) having 50 percent or more by mol of (meth)acrylamide (a) 1 percent or more by mol of N,N-dialkylamino.alkyl(meth)acrylamide (b) as monomer ingredients, aqueous soluble copolymer (B) having 50 percent or more by mol of (meth)acrylamide (a), 1 percent or more by mol of N,N-dialkylamino.alkyl(-meth)acrylamide (b) and 49 percent or less by mol of other copolymer monomer (c) as monomer ingredients, or both of the aqueous soluble copolymer (A) and the aqueous soluble copolymer (B).

According to another aspect of the present invention, there is provided a process for producing an aqueous dispersed solution of a substituted succinic anhydride prepared by dispersing the aqueous soluble copolymer (A) or the aqueous soluble copolymer (B) or a mixture (C) of 99 to 99.9 percent by weight of the substituted succinic anhydride (d) and 10 to 0.1 percent by weight of an oil-in-water type surfactant (e) in aqueous solution containing both the aqueous soluble copolymer (A) and the aqueous soluble copolymer (B).

The substituted succinic anhydrides used according to the present invention can employ all of the known substituted succinic anhydrides used heretofore as a sizing agent, and more particularly comprise those substituted succinic anhydrides which contain hydrophobic hydrocarbon groups each having at least 8 and more preferably 12 to 38 carbon atoms such as substituted succinic anhydrides having alkyl or alkenyl groups. Generally, the substituted succinic anhydrides comprise those feasibly produced by addition reaction of alpha-olefins, inner olefins or olefins of the mixture of them and maleic anhydride. Typically, when the substituted succinic anhydrides are, for example, octadecen-9, tetradecen-7, hexadecen-7, eicosene-11 or the mixture thereof; inner olefin selected from straight-chain internal inner olefin mixture having double bonds produced by the dehydrogenation reaction of straight-chain paraffin are distributed substantially uniformly at the respective positions except alpha-positions; and straight-chain inner olefin mixture having 70 percent or more by weight of total amount of inner olefins disposed at 2-, 3- and 4-positions of double bonds produced by anisotropic reaction of straight-chain alpha-olefin in the presence of catalyst; and the mixture produced by addition reaction of the anhydrides and maleic anhydride, i.e., when the substituted succinic anhydrides are those of alkenyl succinic anhydride having succinyl group in the substituted group, the sizing effect performed by the application of the substituted succinic anhydride of the present invention to the sizing agent for making paper in the paper making process is further improved.

The monomer ingredients of the aqueous soluble copolymer (A) used together with the substituted succinic anhydrides in the abovementioned aspects of the present invention are acrylamide, methacrylamide or both of them, i.e., (meth)acrylamide (a), N,N-dialkylamino. alkylacrylamide, N,N-dialkylamino.alkylmethacrylamide or both of them, i.e., N,N-dialkylamino.alkyl(meth)acrylamide (b). The N,N-dialkylamino.alkyl(meth)acrylamide (b) is basic third class amino group containing monomer represented by the following general formula

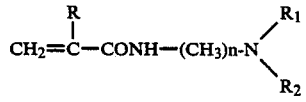

where, in the formula R is a hydrogen or methyl group, $R_1$ and $R_2$ represent a methyl group, ethyl group or propyl group, and n represents an integer of 2 to 4.

The aqueous soluble copolymer (A) comprises a copolymer of 50 percent or more by mol of the (meth)acrylamide (a) and 1 percent or more by mol of N,N-dialkylamino.alkyl(meth)acrylamide (b), and the copolymer (A) can be readily produced by the ordinary copolymerization of the both monomer ingredients prepared at the abovementioned ratio of the compositions, but the copolymer (A) of 80 to 95 percent by mol of the (meth)acrylamide (a) and 20 to 5 percent by mol of N,N-dialkylamino.alkyl(meth)acrylamide (b) obtains more preferable results. The copolymerization is preferably aqueous soluble polymerization, and the molecular weight of the aqueous soluble copolymer (A) is approx. 5,000 or more and more preferably 50,000 or more to be effectively used.

Another aqueous soluble copolymer (B) used together with the substituted succinic anhydride is a copolymer of the monomer ingredient of the aqueous soluble copolymer (A) and the other copolymer monomers (c), and the other copolymer monomers (c) comprise aromatic vinyl monomer such as styrene, alpha-, beta-unsaturated carboxylic acid such as (meth)acrylic acid, itaconic acid, maleic acid, crotonic acid, and preferably those produced readily by aqueous soluble polymerization, but the aqueous soluble copolymers (B) obtains more preferable results by those (B) of 80 percent or more by mol of (meth)acrylamide (a), 5 percent or more by mol of N,N-dialkylamino.alkyl(meth)acrylamide (b) and 15 percent or less by mol of other copolymer monomer (c) in the same manner as the case of the aqueous soluble copolymer (A). Further, the molecular weights of the aqueous soluble copolymer (B) can generally use those having approx. 5,000 or more and more preferably having 50,000 or more to be effectively used.

The contents of the substituted succinic anhydride in the aqueous dispersion of the substituted succinic anhydride according to the present invention can be arbitrary selected, but generally ranging from 0.01 percent by weight to 25 percent by weight to obtain stable aqueous dispersion. The aqueous dispersion of the present invention has particularly excellent utility in the stability at diluting time. If less than the concentration of less than 1 percent by weight, the effect performed by the diluting stability further becomes apparent.

The contents of aqueous soluble copolymer (A) contained in the aqueous dispersed solution according to the present invention or the aqueous soluble copolymer (B), or the both of the aqueous soluble copolymers (A) and (B) are generally preferably ranged from 0.05 percent by weight to 20 percent by weight, and the total of the aqueous soluble copolymers (A) and (B) is preferably selected in a range from about 0.3 to 2 parts by weight.

Further, the aqueous dispersed solution of the substituted succinic anhydride according to the present invention can, of course, additionally comprise other surfactants or aqueous soluble polymer substances. More specifically, when small amount of an oil-in-water type surfactant made, for example, of polyoxyalkylenealkyl(aryl)ether and its sulfuric acid half ester or phosphoric acid ester, the dispersed particle diameter of the substituted succinic anhydride in the aqueous dispersion can be very finely pulverized, and the aqueous dispersed solution of the substituted succinic anhydride which additionally contain small amount of such oil-in-water type surfactant is most preferable for the aqueous dispersed solution of the present invention. In the aqueous dispersion containing the oil-in-water type surfactant, 0.1 to 10 percent by weight of oil-in-water type surfactant contained in the substituted succinic anhydride is ordinarily preferable.

The aqueous dispersed solution of the substituted succinic anhydride according to the present invention constituted as described above is mainly used as a sizing agent for making paper, but may be used as a sizing agent in various fibrous industries. In the utility as the paper making sizing agent, the aqueous dispersion of the substituted succinic anhydride is prepared in arbitrary and desired concentration as internally added sizing to be added to a pulp slurry of paper making raw material or a surface sizing to be coated by arbitrary means on a moistened or dry sheet after a sheet is formed for acidic paper with sulfuric acid band or neutral paper using no sulfuric acid band and all paper making process can be applied.

According to another aspect of the present invention, there is provided a process for producing an aqueous dispersed solution of the substituted succinic anhydride of the first aspect of the present invention readily in an industrial scale and effectively.

The another aspect of the present invention provides a process for producing the aqueous dispersed solution of the substituted succinic anhydride by dispersing the mixture (C) of the substituted succinic anhydride (d) and the oil-in-water type surfactant (e) in the aqueous soluble copolymer (A) or the aqueous soluble copolymer (B) or in the aqueous solution of the both (A) and (B).

The oil-in-water type surfactants (e) used for the mixture in the process for producing the aqueous dispersed solution of the sbustituted succinic anhydride can employ any of those soluble with the substituted succinic anhydride (d), and more preferably contain the surfactants having excellent underwater dispersibility of the substituted succinic anhydride (d) and affecting less adverse influence to the sizing effect. Examples of such oil-in-water type surfactants contain polyoxyalkylene alkyl(aryl)ethers and its sulfuric acid half ester or phosphoric acid ester. The contents of the oil-in-water type surfactant in the mixture is about 0.1 percent by weight to about 10 percent by weight. More preferable oil-in-water surfactant is polyoxyalkylene alkyl(aryl)ether phosphoric acid ethers represented by the following general formula

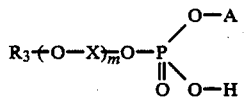

where $R_3$ is an alkyl group or alkylaryl group having 8 or more carbon atoms, X represents an alkylene group, A represents a hydrogen or formula $R'$-$(O\text{-}X)_l$-(in the formula $R'$ is an alkyl group or alkylaryl group, X represents an alkylene group, l represents an integer equal to or greater than 1), and m represents an integer equal to or greater than 1. This is particularly excellent in the solubility with the substituted succinic anhydride or underwater dispersibility of the substituted succinic anhydride. When the oil-in-water surfactant in which $R_3$ in the general formula is an alkyl group or alkylaryl group having 10 to 20 carbon atoms, X is an ethylene group, m is an integer equal to or greater than 5 is employed, the underwater dispersed particles of the substituted succinic anhydride produced by dispersing the mixture (C) of the substituted succinic anhydride and the oil-in-water surfactant in the aqueous soluble copolymer (A), the aqueous soluble copolymer (B) or in the aqueous solution of the both aqueous soluble copolymers (A) and (B) become very ultrafine. When the sizing effect of the aqueous dispersed solution used as paper making sizing agent is further excellent, and becomes more preferable aqueous dispersed solution of the substituted succinic anhydride.

To produce the aqueous dispersed solution of the substituted succinic anhydride according to one aspect of the present invention by employing the mixture (C) of the substituted succinic anhydride (d) and the oil-in-water type surfactant (e), the mixture (C), and the aqueous solution containing 0.1 to 2 percent by weight of the aqueous soluble copolymer (A) or the aqueous soluble copolymer (B) or both the copolymers (A) and (B) are mixed and agitated at arbitrary ratio. The agitator used in this case includes an ordinary propeller type agitator or other various homogenizer or a mixer.

The process for producing the aqueous dispersed solution of the substituted succinic anhydride of one aspect of the present invention may utilize a process for adding and mixing the predetermined amounts of the aqueous soluble copolymer (A) and/or the aqueous soluble copolymer (B) or both the copolymers (A) and (B) in the aqueous dispersion of the substituted succinic anhydride produced by the conventional process, but in the aqueous dispersed solution of the substituted succinic anhydride produced by such conventional process, the stabilization of the underwater dispersibility and dispersed particles of the substituted succinic anhydride is presumed that the abovementioned aqueous soluble copolymer (A) and the aqueous soluble copolymer (B) do not sufficiently act, but as compared with the aqueous dispersed solution of the substituted succinic anhydride produced according to the process for producing the same according to the present invention, it has been discovered that the sizing effect and the diluting stability of the conventional aqueous dispersion are slightly deteriorated.

In the aqueous dispersed solution of the substituted succinic anhydride according to the present invention, the abovementioned aqueous soluble copolymer (A) and the aqueous soluble copolymer (B) added and contained in the dispersed solution exhibit high adsorbility to pulp. Thus, the ultrafine substituted succinic anhydride particles in the dispersed solution can be efficiently adhered to the surface of the fiber of the pulp to perform the advantage of the present invention. Consequently, when the aqueous dispersed solution of the substituted succinic anhydride according to the present invention is applied as paper making sizing agent, various troubles such as wires, rolls and carpets of the paper making machine to be contaminated in the paper making process can be avoided in addition to the excellent sizing effect.

The aqueous dispersed solution of the substituted succinic anhydride and the process for producing the same according to the present invention will be described with reference to the examples performed concretely, the properties of the aqueous dispersed solution of the substituted succinic anhydride prepared are compared and will be described.

EXAMPLES AND COMPARISON EXAMPLES

Parts by weight of the surfactants listed in the columns of Table 1 were added to 100 parts by weight of alkenyl succinic anhydride, agitated and mixed at ambient temperature, and the composition of the alkenyl succinic anhydride was produced. The alkenyl succinic anhydride was produced by reacting inner olefin having 90 percent by weight of olefin having 15 to 18 carbon atoms and double bonds at 2 to 4 positions with maleic anhydride in accordance with the ordinary process.

Then, the composition of the alkenyl succinic anhydride was mixed in the solution of 10 percent by weight of aqueous soluble polymer compound listed in the columns of Table 1, agitated by a homogenization mixer (HV: M type produced by Tokushu Kika Kogyo K.K.) at 50 V for one minute, and the aqueous dispersed solutions of the substituted succinic anhydrides were prepared.

TABLE 1

| Dispersed Solution | Surfactant | Wt. | Aqueous soluble polymer | Wt. |
|---|---|---|---|---|
| Example | | | | |
| (I) | Polyoxyethylenenonylphenol ether phosphoric acid ester (mono-, di-mixture) (Polyoxyethylene: m = 9) | 4 | Copolymer of 90 mol % of acrylamide and 10 mol % of dimethylaminopropylacrylamide (Molecular wt: about 50,000 | 500 |
| (II) | Polyoxyethylenenonylphenol ether phosphoric acid ester (mono-, di-mixture) (Polyoxyethylene: m = 21.5) | 3 | Copolymer of 95 mol % of acrylamide and 5 mol % of dimethylaminopropylacrylamide (Molecular wt: about 500,000) | 500 |
| (III) | Polyoxyethylene distyrenephenol ether phosphoric acid ester (mono-, di-) mixture (Polyoxyethylene: m = 13) | 5 | Copolymer of 80 mol % of acrylamide and 20 mol % of dimethylaminopropylmethacrylamide (Molecular wt: about 150,000) | 500 |
| Comparison Example | | | | |
| (I) | the same as solution in column (I) | 4 | Copolymer of 90 mol % of acrylamide and 10 mol % of dimethyl aminoethylmethacrylate methylchloride (Molecular wt: about 100,000) | 500 |
| (II) | the same as solution in column (II) | 3 | Decomposed Hofmann of polyacrylamide having fourth ammonium (Molecular wt: about 250,000 20 mol % of cationic group) | 500 |
| (III) | Polyoxyethylenenonylphenol ether (Polyoxyethylene m = 15) | 5 | Cationic starch (Neo-Posiparin) produced by Matsutoya Kagaku Kogyo K.K.) | 2000 |

EXPERIMENTS

The aqueous dispersed solutions produced in the above examples and comparison examples were added to 2 percent by weight of pulp slurry (L-BKP, c.s.f.: 400 cc.) containing 20 percent by weight of heavy calcium carbonate filler (Escaron #800 produced by Sankyo Seifun K. K.) with respect to the weight of the pulp so that the compositions of the substituted succinic anhydride and the surfactant in the aqueous dispersed solution became 0.2 percent by weight of the pulp, then 0.5 percent by weight of cationic starch (Neo-Posiparin) produced by Matsutoya Kagaku Kogyo K.K.) to the weight of the pulp as a fixing agent was added, manual paper of the weight of 80 g/m$^2$ was prepared in accordance with the ordinary process, dried by a rotary drier at 110° C. for 120 seconds, and manual paper was produced.

The produced paper was prepared in moisture and measured in accordance with JIS (the Japanese Industrial Standards) with respect to Stöckigt sizing degree (sec.) and listed in Table 2.

In Table 2, the emulsion mean particle diameters (micron) of the aqueous dispersed solution, the emulsion mean particle diameters (micron) of the dispersed solutions after allowed to stand for 10 hours, and the stabilize of the diluted dispersion diluted so that the composition of the alkenyl succinic anhydride and the surfactant became 0.05 percent by weight with civil water having 100 of total hardness in the dispersed solutions are listed.

TABLE 2

| Dispersed solution | Sizing degree (sec.) | Mean particle size of emulsion (micron) Direct after preparation | After 10 hrs. | Diluted Stability (0.05 wt. %) |
|---|---|---|---|---|
| (I) | 39 | 0.5 or less | 0.5 or less | Good |
| (II) | 38 | 0.5 or less | 0.5 or less | Good |
| (III) | 40 | 0.5 or less | 0.5 or less | Good |
| (I) | 27 | 1 | 7–10 | Discrete |
| (II) | 24 | 1 | 5–7 | Aggregate |
| (III) | 29 | 1 | Precipitated | Good |

According to the present invention, the aqueous dispersed solution of the substituted succinic anhydride and the process for producing the same are as constituted and operated as described above, and the aqueous solution of the substituted succinic anhydride has the same diluted stability as the aqueous dispersion of the substituted succinic anhydride utilzing the conventional cationic starch by the stabilization of the aqueous soluble copolymer (A) and/or the aqueous soluble copolymer (B) in the aqueous dispersed solution or in both the copolymers (A) and (B), and provides the feasibility of handling in case of utilizing the emulsion particle size and industrial scale equivalent to those of the aqueous dispersion of the substituted succinic anhydride using the conventional synthetic polymer.

Therefore, when the aqueous dispersed solution of the substituted succinic anhydride according to the present invention is used as the paper making sizing agent, excellent sizing effect can be not only provided, but the contaminations of the wires, rolls, carpets of the paper making machine can be eliminated to produce the paper.

Further, according to the process for producing the aqueous dispersed solution of the substituted succinic anhydride in accordance with the present invention, the aqueous dispersed solution of the substituted succinic anhydride having the abovementioned operation and effects can be effectively produced in an industrial scale without necessity of particularly strong agitator.

What is claimed is:

1. An aqueous dispersed solution of a substituted succinic anhydride comprising:

i. an aqueous soluble copolymer having as monomer ingredients at least 50% by mol (meth) acrylamide, at least 1% by mol N,N-dialkylamino alkyl(meth)acrylamide, and 0 to 49% by mol of other copolymer monomers; and ii. a polyoxyalkylene alkyl(aryl)ether phosphoric acid ester.

2. The aqueous dispersed solution of a substituted succinic anhydride according to claim 1, wherein said substituted succinic anhydride is alkenyl succinic anhydride.

3. A process for producing an aqueous dispersed solution of a substituted succinic anhydride comprising:

mixing the substituted succinic anhydride and a polyoxyalkylene alkyl(aryl)ether phosphoric acid ester to produce a mixture; and then dispersing the mixture in an aqueous solution containing an aqueous soluble copolymer having as monomer ingredients at least 50% by mol (meth)acrylamide, at least 1% by mol N,N-dialkylamino alkyl(meth)acrylamide, and 0 to 49% by mol of other copolymer monomers, to produce the aqueous dispersed solution.

4. The process according to claim 3 wherein said substituted succinic anhydride is alkenyl succinic anhydride.

* * * * *